US005457664A

United States Patent [19]

Izukawa et al.

[11] Patent Number: 5,457,664

[45] Date of Patent: Oct. 10, 1995

[54] ENERGY SAVING TIMEPIECE

[75] Inventors: Takahiro Izukawa; Yukari Hoshino; Takumi Matsuda, all of Tokyo, Japan

[73] Assignee: Seikosha Co., Ltd., Japan

[21] Appl. No.: 117,895

[22] Filed: Sep. 7, 1993

[30] Foreign Application Priority Data

Sep. 8, 1992 [JP] Japan ..... 4-239295

[51] Int. Cl.[6] ..... G04B 14/04

[52] U.S. Cl. ..... 368/80; 368/223; 368/203; 368/204

[58] Field of Search ..... 368/66, 11, 80, 368/76, 223–224, 203, 204

[56] References Cited

U.S. PATENT DOCUMENTS 4,281,405 7/1981 Besson et al. ..... 368/66

4,433,918 2/1984 Nishimura et al. ..... 368/74

5,267,222 1/1993 Williams et al. ..... 368/155

*Primary Examiner*—Bernard Roskoski

*Attorney, Agent, or Firm*—Adams & Wilks

[57] ABSTRACT

A timepiece has movable indicator hands for the analog display of current time. An ambient state, such as ambient light intensity, presence of a person in a room, or infrared radiation is sensed. Whether or not time indication is necessary is determined depending on the ambient state. If it is determined that the ambient state indicates that time indication is not necessary, then the movement of the indicator hands is stopped to conserve energy and reduce noise. When the ambient state indicates that time indication is necessary, the position of the indicator hands is adjusted from a stop position to a position indicative of current time.

35 Claims, 8 Drawing Sheets

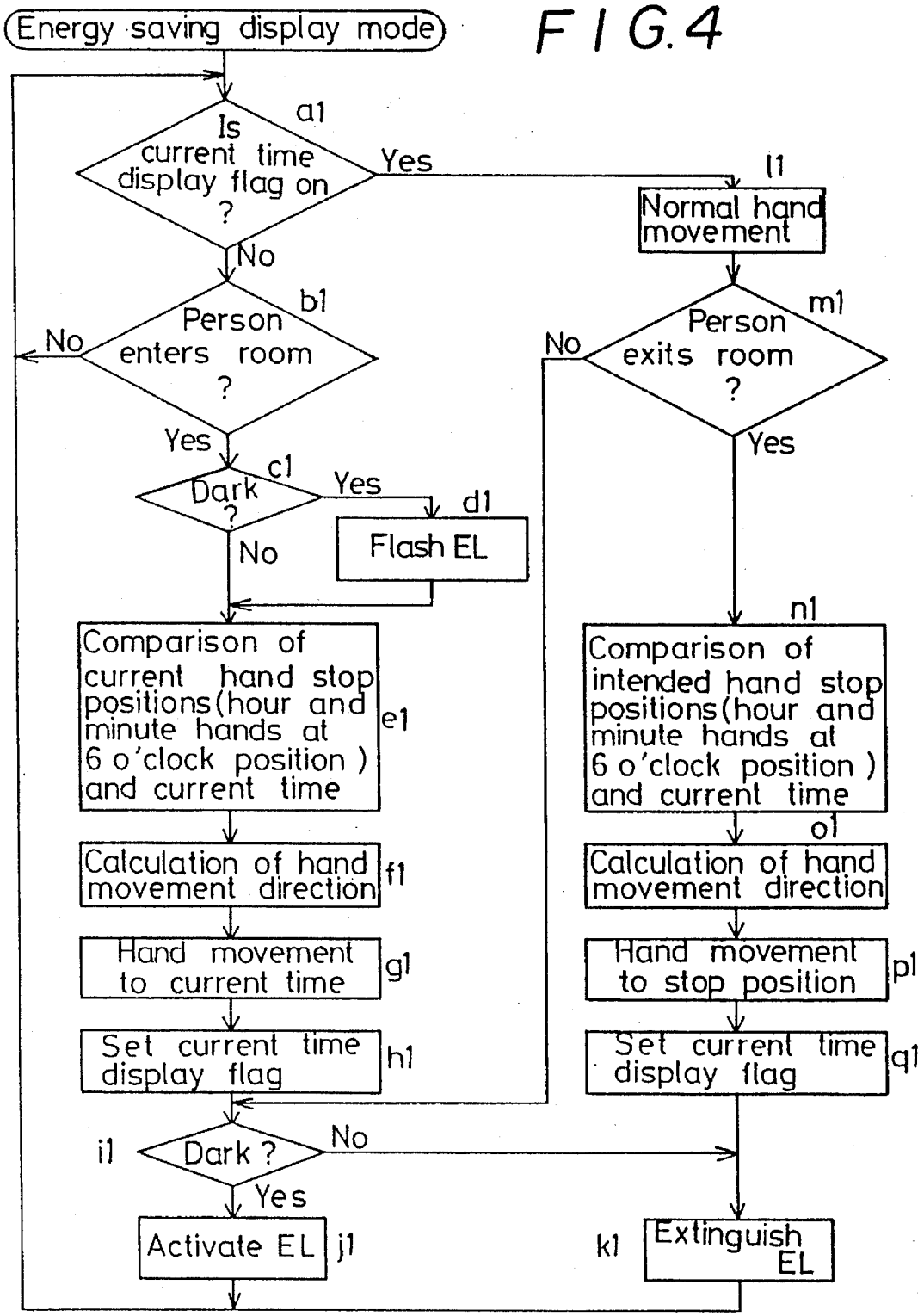
FIG.4
Energy saving display mode
a1
Is current time display flag on ?
Yes
No
l1
Normal hand movement
b1
Person enters room ?
No
Yes
m1
Person exits room ?
No
Yes
c1
Dark ?
Yes
No
d1
Flash EL
Comparison of current hand stop positions (hour and minute hands at 6 o'clock position ) and current time
e1
n1
Comparison of intended hand stop positions (hour and minute hands at 6 o'clock position ) and current time
Calculation of hand movement direction
f1
o1
Calculation of hand movement direction
Hand movement to current time
g1
Hand movement to stop position
p1
Set current time display flag
h1
Set current time display flag
q1
i1
Dark ?
No
Yes
Activate EL
j1
k1
Extinguish EL

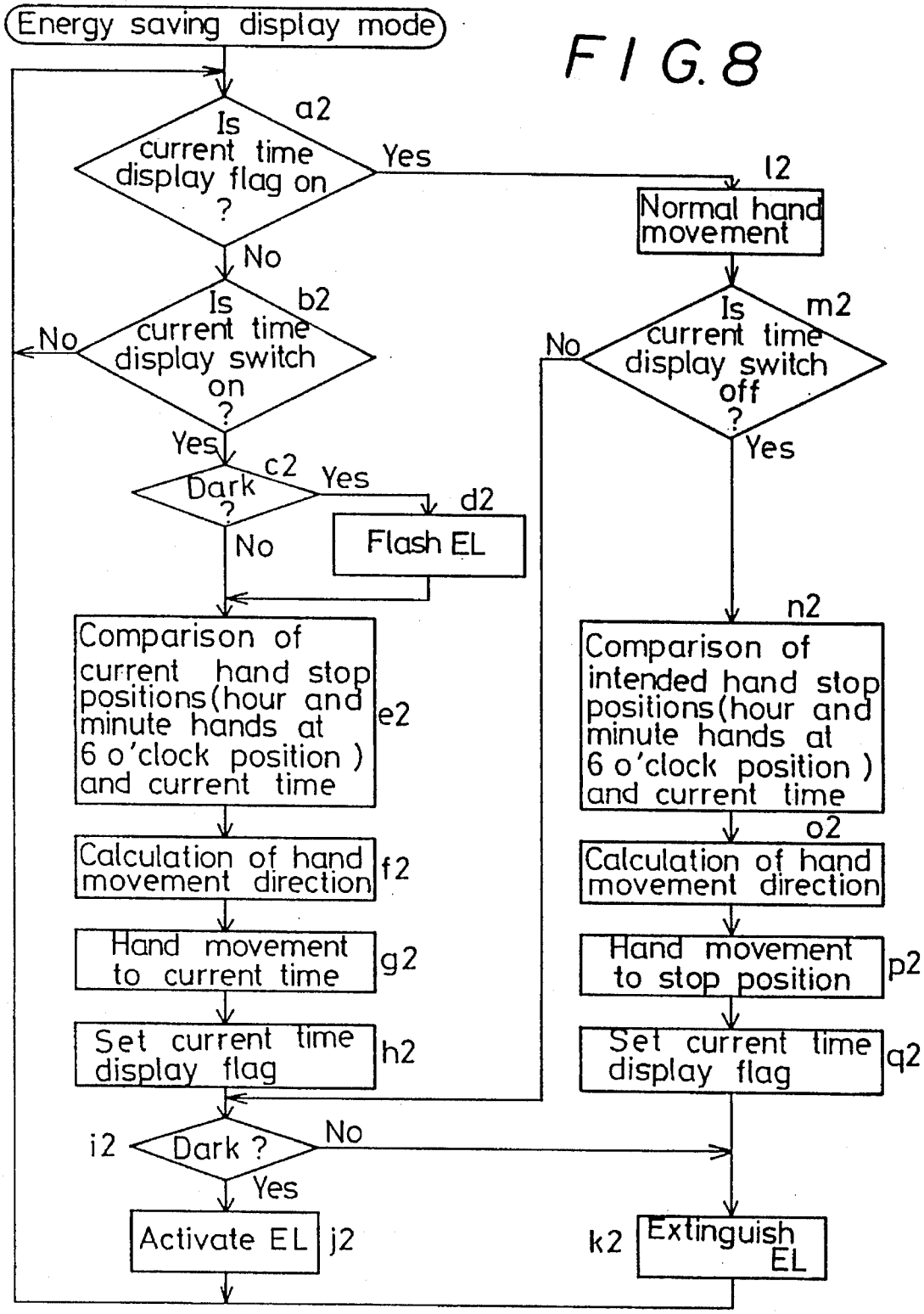
Energy saving display mode
FIG. 8
a2
Is current time display flag on ?
Yes
No
l2
Normal hand movement
b2
Is current time display switch on ?
No
Yes
m2
Is current time display switch off ?
No
Yes
c2
Dark ?
Yes
No
d2
Flash EL
Comparison of current hand stop positions (hour and minute hands at 6 o'clock position ) and current time
e2
n2
Comparison of intended hand stop positions (hour and minute hands at 6 o'clock position ) and current time
Calculation of hand movement direction
f2
o2
Calculation of hand movement direction
Hand movement to current time
g2
Hand movement to stop position
p2
Set current time display flag
h2
Set current time display flag
q2
i2
Dark ?
No
Yes
Activate EL
j2
k2
Extinguish EL

ENERGY SAVING TIMEPIECE

BACKGROUND OF THE INVENTION

The present invention pertains generally to a timepiece. More particularly, the present invention pertains to a timepiece capable of determining when time indication is not necessary so that movement of indicator hands can be stopped to conserve energy.

Conventionally, timepieces have indicator hands including a second hand, a minute hand and hour hand to display current time. A wheel series reduces the speed of rotation of a drive motor so that the indicator hands can be driven at appropriate rotational speeds.

In conventional timepieces, the indicator hands are continuously driven. Thus, the motor which drives the indicator hands needlessly consumes electricity during times when display of the current time is not necessary, such as when it is dark, when there are no people present, etc. Furthermore, the continuous rotation of the indicator hands generates a constant noise, making sleep in the presence of the conventional timepiece difficult.

It is also known to illuminate the dial of the conventional timepiece. This illumination is effective to allow viewing of the current time in a dark room. However, this illumination of the dial also needlessly consumes electricity when the ambient light is above a certain level, when there are no people present, etc.

Therefore, there is a great need for an energy saving timepiece that does not needlessly consume electricity to drive time indicator hands, and/or to illuminate a dial, during times when time display and dial illumination is not necessary.

SUMMARY OF THE INVENTION

The present invention is intended to overcome the drawbacks of the conventional art.

It is an object of the present invention to provide a timepiece having energy conserving features.

It is another object of the present invention to provide a timepiece that does not generate noise while a person is sleeping.

In accordance with the present invention, a timepiece is provided with indicator hands for displaying time. Current time is counted and displayed by the indicator hands. An ambient state (such as the presence of a person, ambient light, etc.) is sensed. A determination is made as to whether time indication is necessary, and movement of the indicator hands is controlled depending on the sensed ambient state. The movement of the indicator hands is stopped when time indication is not necessary, and the position of the indicator hands is adjusted to indicate the current time when the time indication is necessary. Thus, in accordance with the present invention, consumption of electricity is reduced by stopping the movement of the indicator hands when it is determined that time indication is not necessary. Also, since movement of the time indicator hands is stopped when time indication is not necessary, noise generated by the movement of the indicator hands is also stopped.

According to one aspect of the present invention, the ambient light surrounding the timepiece is sensed. It is determined that time indication is not necessary when the ambient light is below a predetermined level, and that time indication is necessary when the ambient light is above the predetermined level. The movement of the indicator hands is stopped when the ambient light is below the predetermined level, and the position of the indicator hands is adjusted to indicate the current time when the ambient light again is above the predetermined level. In this manner, the movement of the time indicator hands ceases when the surroundings of the timepiece is dark, and energy is conserved and no noise is generated during times while, for example, the user is sleeping.

In accordance with another aspect of the present invention, the presence of a person is sensed. It is determined that time indication is not necessary when the presence of a person is not sensed, and that time indication is necessary when the presence of a person is sensed. In this case, if the ambient light level is also determined, illumination of the dial can be controlled so that the dial is illuminated only when the ambient light is below a predetermined level and the presence of a person is sensed.

In addition, when the presence of the person is not sensed, the movement of the indicator hands is stopped so as to conserve energy. When the presence of the person is again sensed, the position of the indicator hands is adjusted to indicate the current time. The presence of a person can be sensed, in accordance with the present invention, by sensing infrared radiation given off by the person.

When it is determined that time indication is not necessary, the indicator hands are displaced to a predetermined stop position. The least amount of movement required to dispose the indicator hands at the predetermined stop position is calculated. Thus, when it is determined that time indication is not necessary, the indicator hands are quickly and individually rotated in the directions requiring the least amount of movement to displace them to the predetermined stop position. Further, the least amount of movement required to displace the indicator hands from the predetermined stop position to a position indicating the current time is also calculated. Thus, when it is determined that time indication is necessary, the time indicator hands are quickly and individually moved in the direction of least movement to their respective positions to indicate the current time.

In addition to the analog display of time provided by the indicator hands, a digital time display continuously digitally displays the current time. The illumination of the digital time display is flashed when the position of the indicator hands is being adjusted to indicate the current time so that a person viewing the timepiece knows that the analog time displayed is incorrect. Thus, in accordance with the present invention, a timepiece is provided that requires movement of the indicator hands only when it is determined that time indication is necessary, thereby conserving power and reducing noise.

BRIEF DESCRIPTION OF THE DRAWINGS

FIG. 4 is a flow chart for describing the operation of the timepiece shown in FIG. 1;

FIG. 8 is a flow chart for describing the operation of the alarm clock shown in FIG. 5.

DETAILED DESCRIPTION OF THE INVENTION

Figure 1:
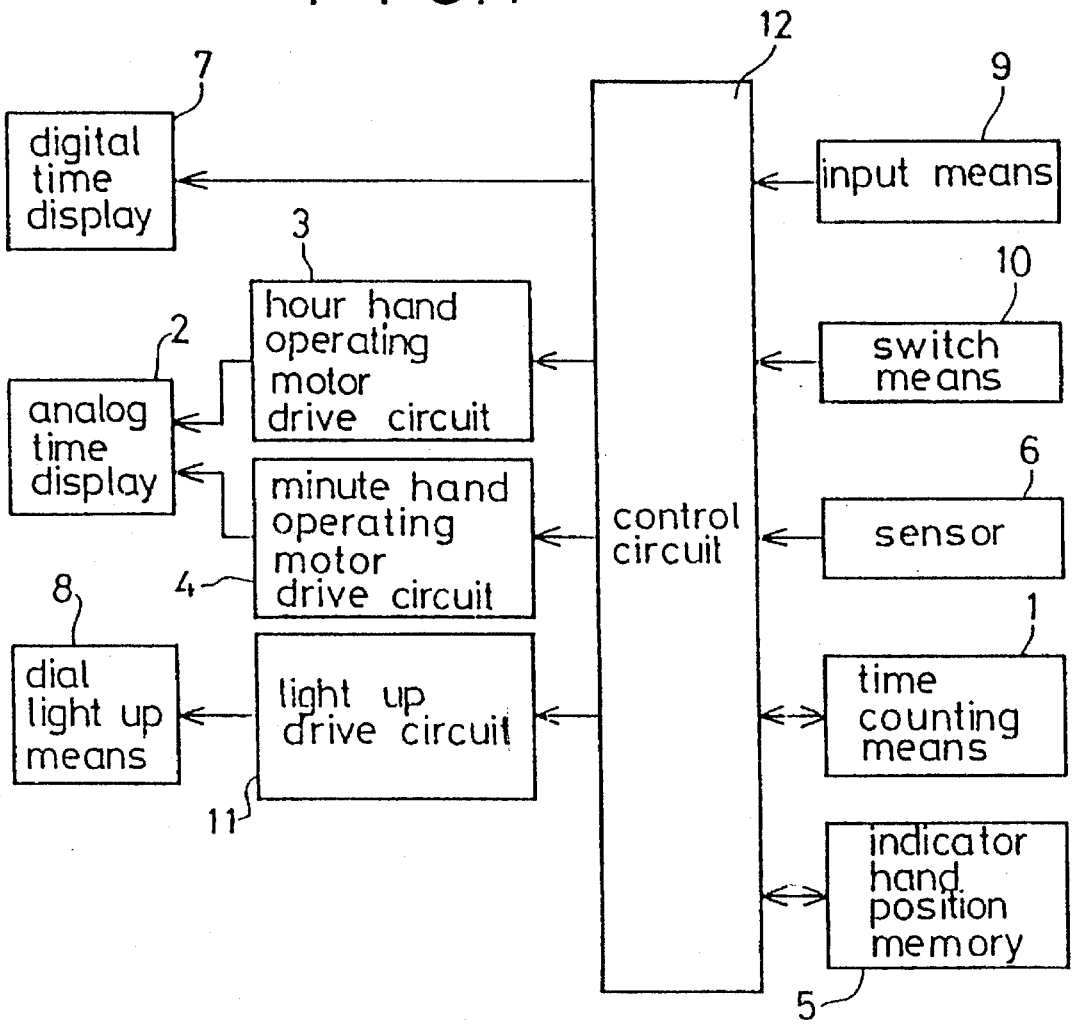
FIG. 1 is a block diagram showing an embodiment of a timepiece in accordance with the present invention.

A wall clock constructed according to one embodiment of the present invention is shown in FIG. 1. Time counting means 1 counts a current time. An analog time display 2 includes hour and minute indicator hands. An hour hand operating motor drive circuit 3 and a minute hand operating motor drive circuit 4 drive the hour hand and minute hand, respectively, of the analog time display 2. The motor driving circuits 3, 4 are independently controlled and drive the hands in either the clockwise or counterclockwise direction. An indicator hand position memory 5 includes two up-down counters for independently counting each of the display positions of the hour and minute hands. The indicator hand position memory 5 includes an optical sensor (not shown) that resets the up-down counters when the positions of the hour hand and minute hand indicate 12:00 o'clock. Alternatively, the positions of the hour and minute hands can be detected using electronic expressing codes formed on a rotating disc, such as used in an analog chime clock. For example, the hour hand position can be detected by forming electronic expressing codes of hour digits on a disc which rotates in conjunction with the hour hand. The codes are read by contact electrodes to determine the hour hand position.

Time adjustment is performed by the hour hand operating motor drive circuit 3, minute hand operating motor drive circuit 4 and indicator hand position memory 5. A sensor 6, which may be an infrared sensor, CdS or the like, senses a state when time indication is unnecessary, such as when it is dark, when people are absent, etc., and generates an output signal dependent thereon. A digital time display 7 comprised of a liquid crystal display or the like continually displays the current time counted by the time counting means 1.

A dial light-up means 8 comprises an electro-luminescence (EL) element 15 and illuminates the display dial (not shown) when it is dark and the current time is displayed by the hands of the analog time display 2. The EL element 15 is extinguished when it is light (i.e., the ambient light is above a predetermined level), or when the movement of the indicator hands is stopped.

Input means 9, including input keys or the like, is used to perform initial time adjustment to set the timepiece. Switch means 10 including an operation mode change-over switch is provided so that an energy-saving display operation (interrupted time display) mode can be selected or de-selected. By de-selecting the energy-saving display mode, a standard display (continuous time display) mode can be selected by the switch means 10 to operate the timepiece as a standard clock. A light-up drive circuit 11 drives the dial light-up means 8. A control circuit 12 comprises a CPU, RAM and ROM and manages overall control of the timepiece.

Figure 2:
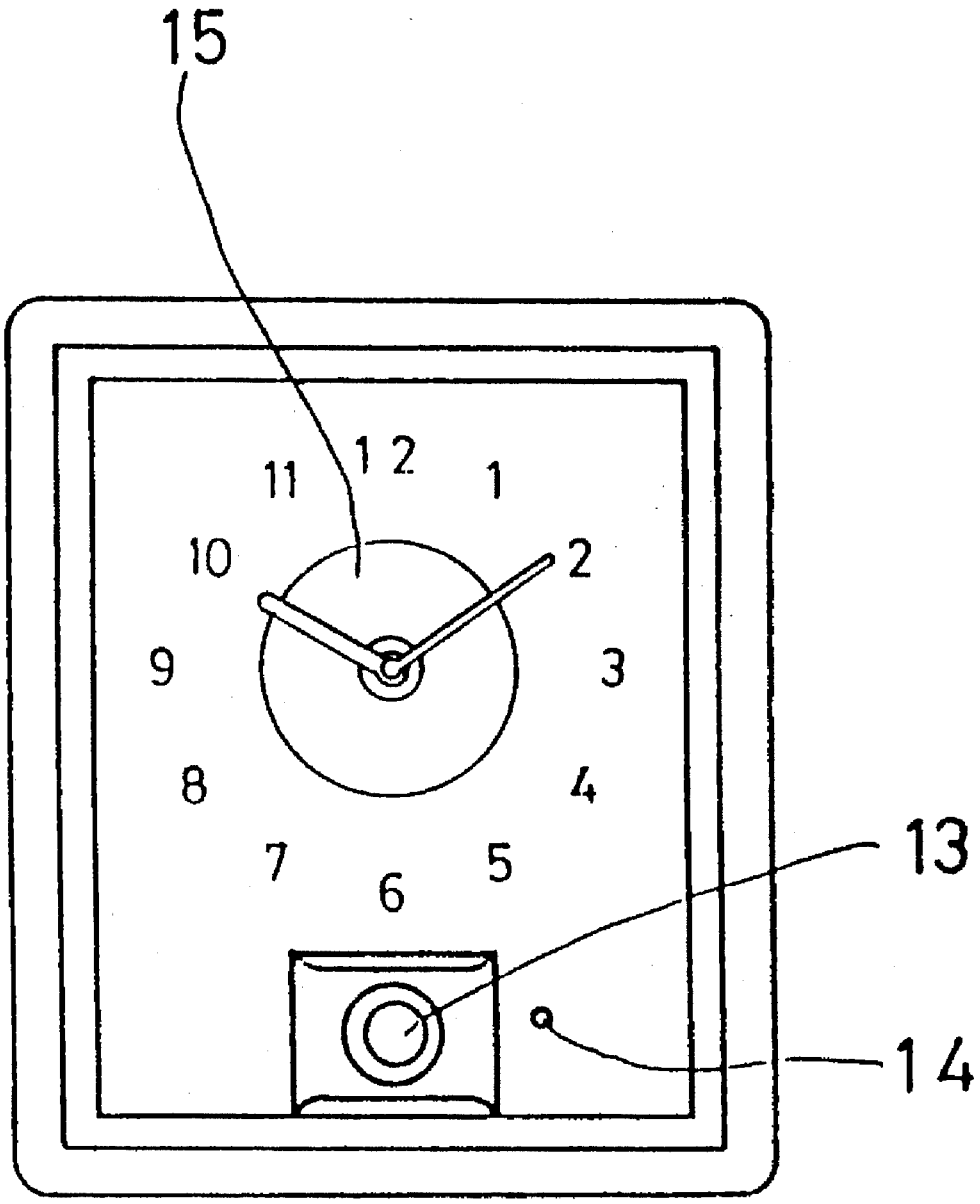
FIG. 2 is a front view of a wall clock in accordance with one embodiment of the present invention.
Figure 3:
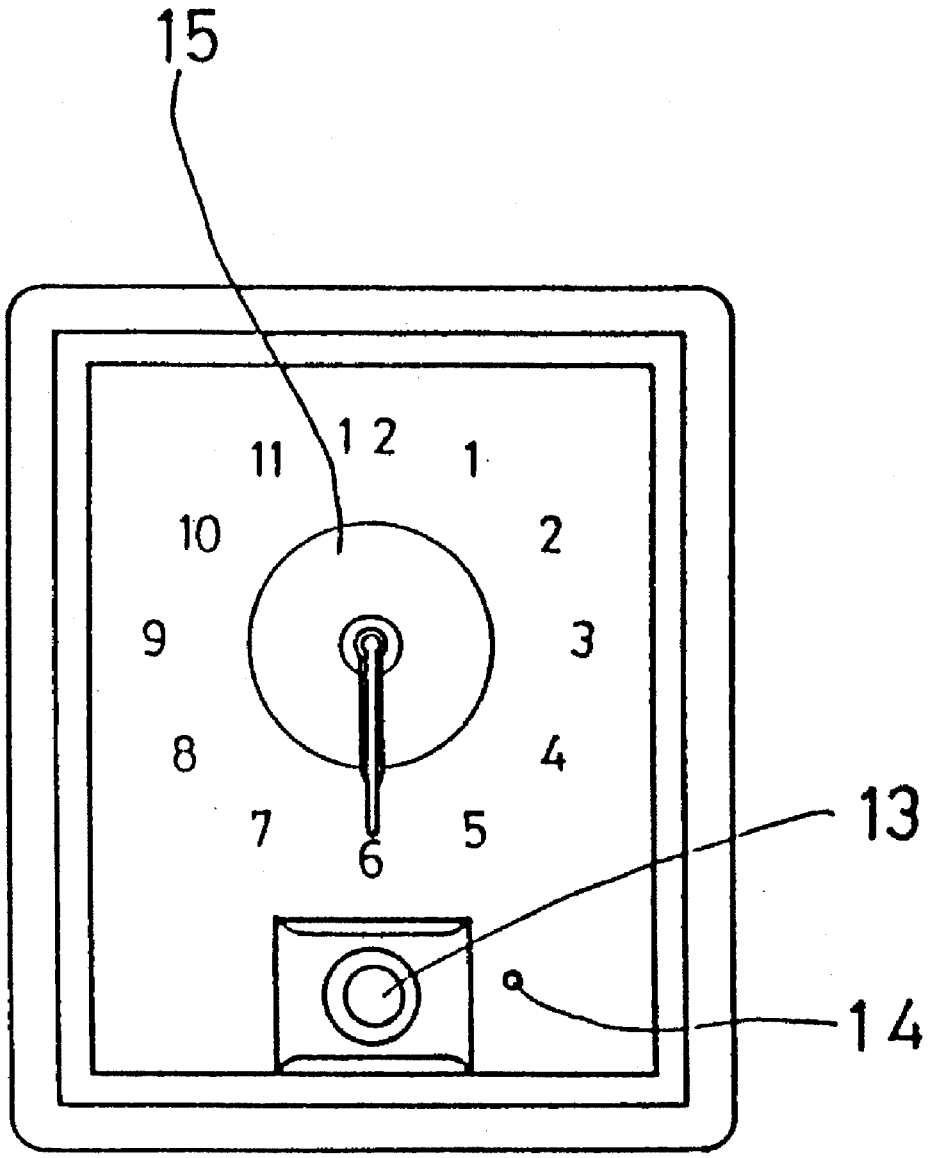
FIG. 3 is a front view of the wall clock shown in FIG. 2, showing the indicator hands at a predetermined stop position.

FIGS. 2 and 3 show examples of the embodiment shown in FIG. 1 configured as a wall clock. FIG. 2 shows a condition when the indicator hands are operational for indicating current time, and FIG. 3 shows the position of the indicator hands when the time indication by the hands is stopped and the indicator hands are at a predetermined stop position. As shown, an infrared sensor 13 and a CdS sensor 14 constitute the sensor 6. The EL element 15 constitutes the dial light-up means 8.

When a person is in the room and the ambient light is above a predetermined level, the current time is displayed by the digital display 7 and also by the indicator hands. In this state, the EL element 15 is extinguished. When a person is in the room and when it is dark (i.e., the ambient light is below a predetermined level), the EL element 15 emits light to light up the display dial while the current time is displayed by the digital display 7 and also by the indicator hands. When a person is no longer in the room, the hour and minute hands are moved independently to a predetermined stop position (which may be, for example, the 6:30 position) and movement of the hour and minute hands is stopped. In this state, the EL element 15 is extinguished. Stated otherwise, during periods when people are absent, hand movement is suspended and unnecessary electricity consumption is prevented. By positioning the hour and minute hands at a consistent and abnormal time-indicating position (e.g., all indicator hands at the 6:30 position), it is less likely that a person entering the room and viewing the time display will be confused and mistakenly read the wrong time.

When a person re-enters the room, the presence of the person is sensed. The hour and minute hands are moved independently at high speed to indicate the current time. If the room is dark, the EL element 15 flashes during adjustment whereby the user is informed that time adjustment is taking place. If it is still dark when adjustment is finished, the EL element 15 emits light and the current time display is illuminated. The EL element 15 may also flash even if the room is light during the adjustment period to thereby indicate that time adjustment is taking place.

The operation of the embodiment shown in FIGS. 1, 2 and 3 will be explained in more detail with reference to the flow chart of FIG. 4. The operation in the case where a person is in the room, and the inside of the room is bright, will first be explained. A current time display flag instructing normal movement of the indicator hands provided in the analog display means is in an ON state. At this time, the control circuit 12 determines that the current time display flag is in the ON state (step a1). The control circuit 12 controls the hour hand operating motor drive circuit 3 and the minute hand operating motor drive circuit 4 and executes normal operation of the hour and minute hands. The analog time display 2 displays the current time together with the digital time display 7 (step l1).

During this time, at regular sampling intervals, human infrared rays are sensed by the infrared sensor 13 provided in the sensor 6. The infrared sensor 13 produces a corresponding output which is received by the control circuit 12, and the existence of a person in the room in which the clock is situated is judged based on the sensor output (step m1). If the infrared sensor 13 senses the presence of a person (i.e., the infrared radiation is above a predetermined level), the current time display flag is kept in the ON state. Also, the output of the CdS sensor 14 provided in the sensor 6 is received by the control circuit 12, and if the interior of the room is judged to be not dark (step i1), the EL element 15 is placed in an extinguished state (step k1). As long as the person stays in the room and the ambient light is above a predetermined level, the analog time display 2 and the digital display 7 display the current time, and the EL element 15 remains in the extinguished state.

However, if the room should become dark, the resistance value of the CdS sensor 14 rises, whereupon it is judged that the ambient light has fallen below a predetermined level (step i1). The EL element 15 is activated, and illumination of the display dial of the analog time display begins (step j1). Subsequently, the steps following step a1 are repeatedly executed so that the analog time display 2 and the digital display 7 display the current time, and the EL element 15 emits light and illuminates the display dial of the analog time display 2.

The ON state of the analog time display flag is judged in step a1. If the person leaves the room during the time while the indicator hands are moving normally (step l1), the output of the infrared sensor 13 is interrupted, and it is determined that a person is not present in the room (step m1).

When it is determined that a person is not present, the current time is output by the time counting means 1. At the same time, the hour hand and minute hand stop positions are output from the indicator hand position memory 5. Thus, the position of each hand and the current time are individually compared (step n1), and the direction of movement which entails the least amount of hand movement to the predetermined stop position is calculated for each indicator hand (step o1). When the direction of movement is determined, the hour hand operating motor drive circuit 3 and the minute hand operating motor drive circuit 4 are operated. Each hand is moved at high speed in its respective determined direction to the predetermined stop position (step p1), as shown in FIG. 3. When the movement of the hands to the stop position is completed, the current time display flag is reset (step q1), and time display by the movement of the indicator hands provided in the analog time display 2 is stopped. When the time display by the indicator hands is stopped, the EL element 15 is extinguished (step k1). Thus, in accordance with the present invention, electrical consumption by the analog time display 2 is eliminated during periods when no person is present in the room.

When a person re-enters the room during a state when the analog time display 2 is stopped, the time counting means 1 continues to count the current time. The digital time display 7 displays the current time, and the control circuit 12 determines the status of the current time display flag (step a1). The infrared sensor 13 of the sensor 6 senses the human infrared rays and determines that a person is present (step b1). It is noted that as an alternative to the infrared sensor 13, a proximity sensor (not shown) may be used to sense the presence or absence of a person.

The control circuit 12, which receives the output from the sensor 6, determines that a person is present (step b1). Subsequently, the output state of the CdS sensor 14 of the sensor 6 is used to detect whether the ambient light is above or below a predetermined level (step c1). If the room is dark, a flashing signal is supplied to the light-up drive circuit 11, and the EL element 15 is flashed (step d1). At this time, time adjustment of the hour hand and minute hand is initiated. The flashing of the EL element 15 may be provided even if the room is bright, so that a person viewing the timepiece can determine that analog time adjustment is being made. Alternatively, if the room is bright, the flashing of the EL element 15 may not occur so as to conserve energy.

In the time adjustment operation, the current stop positions of the hour hand and minute hand are output from the indicator hand position memory 5. The position of each hand and the current time are individually compared (step e1), and the direction of movement which entails the least amount of hand movement from the stop position to the current time position is calculated (step f1). Once the hand movement directions are decided, the hour hand operating motor drive circuit 3 and the minute hand operating motor drive circuit 4 are operated, and the respective hands are moved at high speed in the decided direction to indicate the current time (step g1).

After the completion of the time adjustment, the current time display flag is set (step h1), and the light intensity of the room or the like is again determined (step i1). If it is determined that the room is dark, the EL element 15 is activated (step j1), and if the room is not dark, the EL element 15 is extinguished (step k1). Subsequently, the process returns to step a1, where the status of the current time display flag is determined. If the current time display flag is in the ON state, normal movement of the hands continues (step l1). By starting normal movement of the hands, time display by the analog time display section 2 is started. When the presence of a person is not detected, the time display by the movement of the indicator hands of the analog time display 2 is stopped. Thus, time display by the movement of the indicator hands is executed only when it is necessary so that unnecessary electrical consumption by the analog time display section 2 is eliminated and energy savings is made possible. Furthermore, by operating the switch means 10, the analog time display 2 can be operated as a standard clock.

Figure 5:
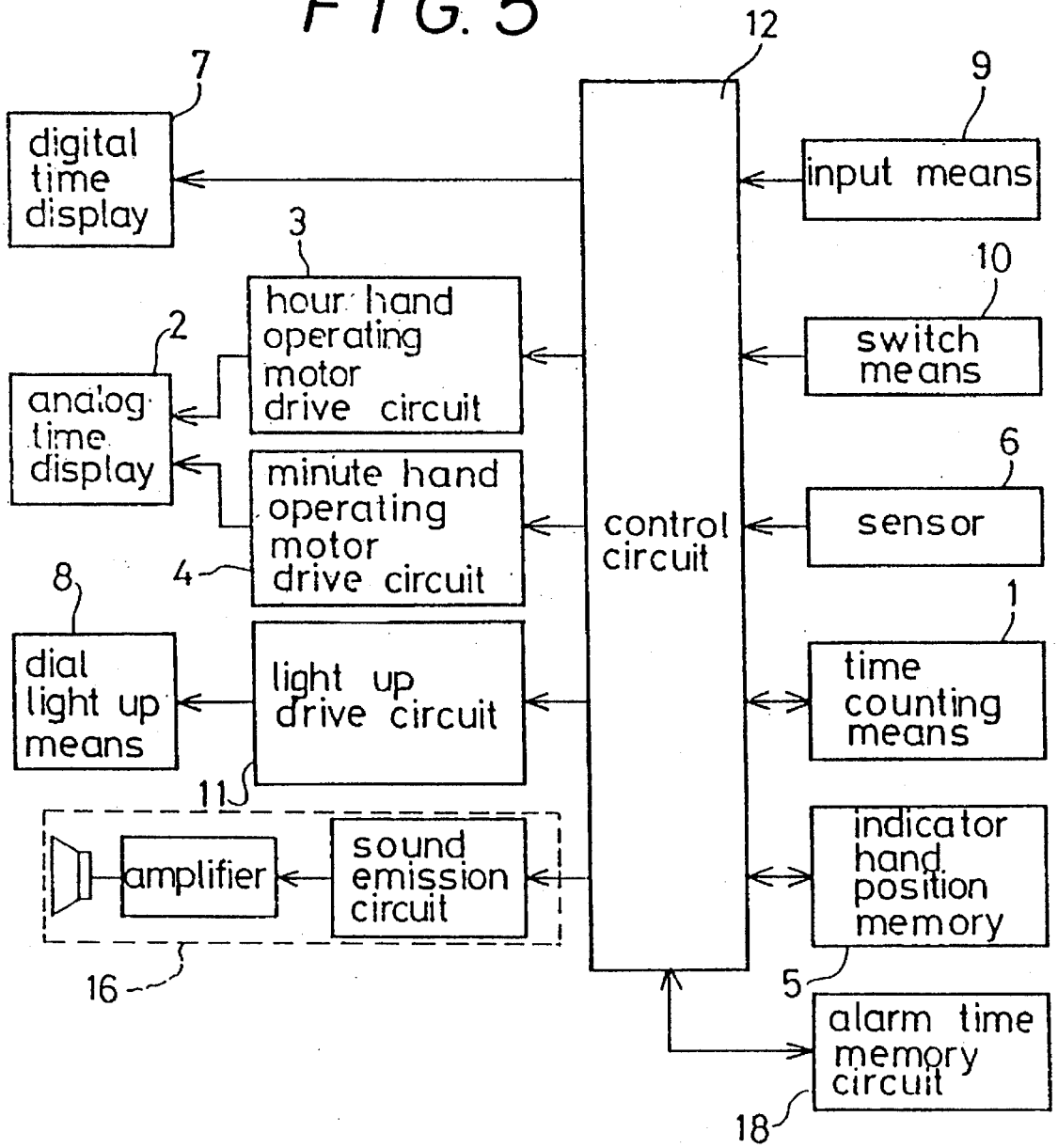
FIG. 5 is a block diagram showing an embodiment of an alarm clock in accordance with the present invention.

Next, another embodiment of the present invention will be explained with reference to FIG. 5. FIG. 5 is a block diagram in which components having a similar function to those shown in FIG. 1 are designated by the same reference numerals. A sound emission block 16 comprising a sound emission circuit, an amplifier and a speaker is connected to the control circuit 12. The sound emission block 16 emits an alarm tone at an alarm time.

Figure 6:
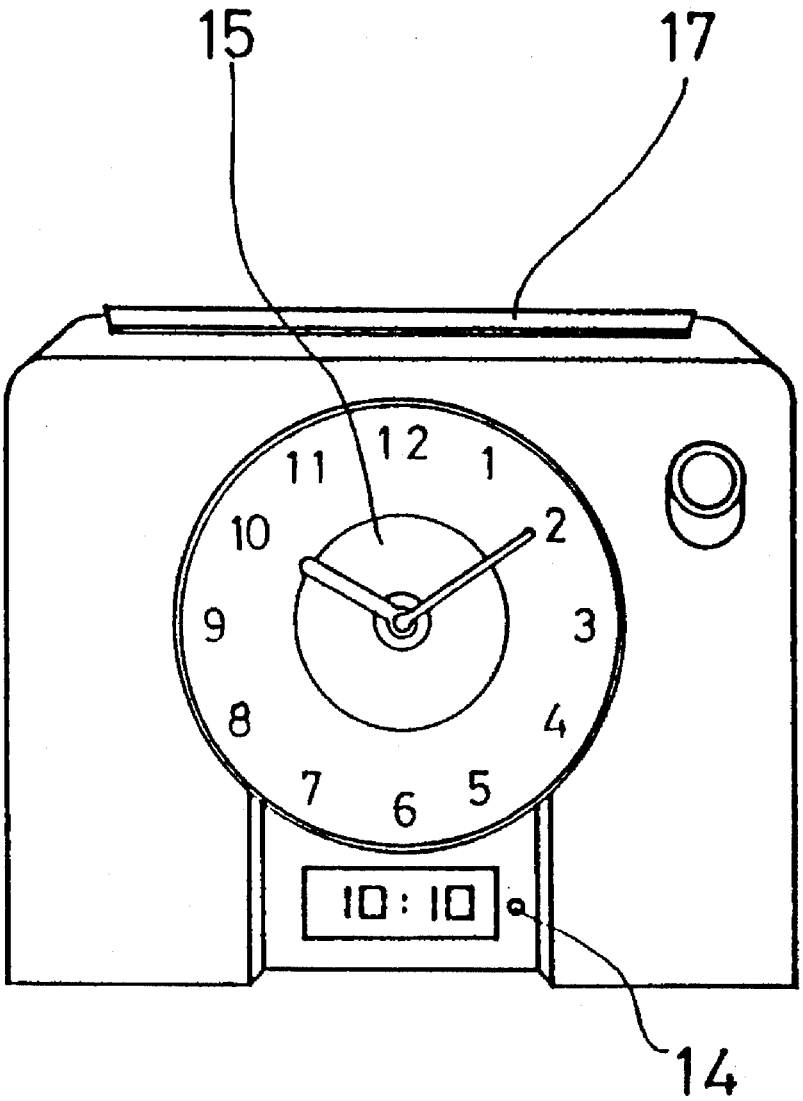
FIG. 6 is a front view of the alarm clock shown in FIG. 5.
Figure 7:
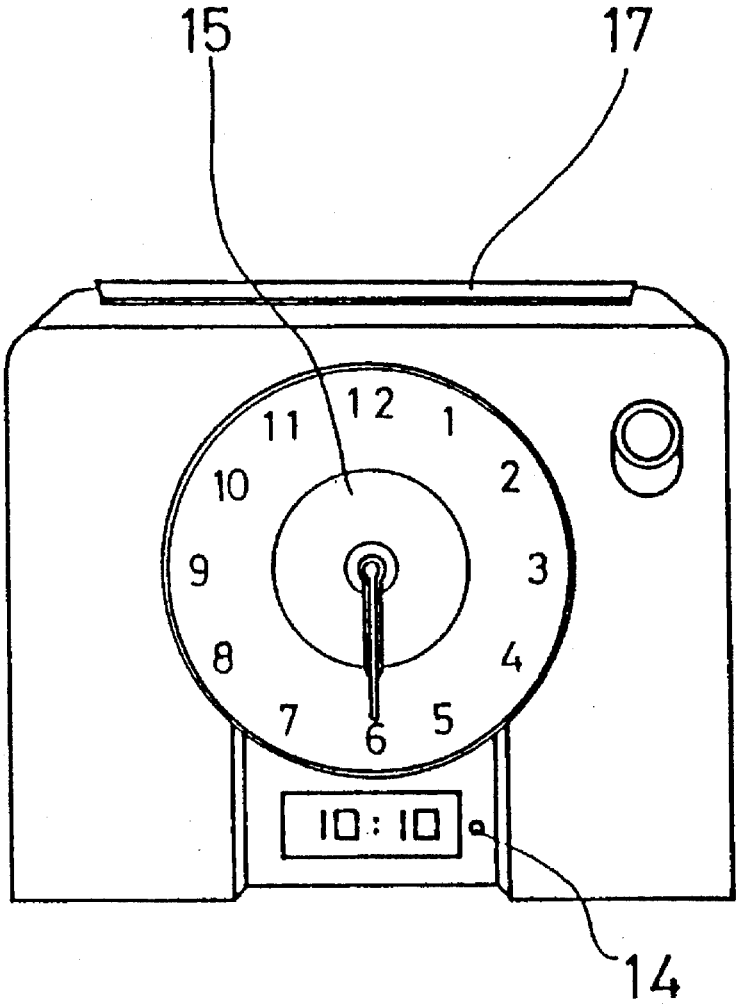
FIG. 7 is a front view of the alarm clock shown in FIG. 6, showing the indicator hands at a predetermined stop position.

FIGS. 6 and 7 show an example of the FIG. 5 embodiment utilizing an alarm clock in accordance with the present invention. FIG. 6 shows the indicator hands in the normal time display mode, and FIG. 7 shows the position of the indicator hands when the time indication by the hands is stopped and the indicator hands are at the predetermined stop position. In FIGS. 6 and 7, the CdS sensor 14 and the EL element 15 are shown. A current time display switch 17 is provided in the switch means 10. By operating the current time display switch 17, current time display is executed by the analog time display 2. An alarm time memory circuit 18 (shown in FIG. 5) stores the alarm time.

In the embodiment of the present invention shown in FIGS. 5, 6 and 7, time display is normally performed by the digital time display 7. The analog time display 2 stops each of the indicator hands at a fixed stop position as shown, for example, in FIG. 7. When time display is not being executed and the user requires analog time display, the user switches the current time display switch 17 to the ON position. Time display is then initiated by the normal time displaying movement of the indicator hands after each hand has moved at a high speed from its predetermined stop position to the position showing the current time. At this time, the ambient light level is sensed by the CdS sensor 14, and the EL element 15 is activated if it is dark. If time display by the analog time display 2 is not required, the current time display switch 17 is turned off. In this case, each indicator hand is moved at high speed to the predetermined stop position and stopped. Analog time display is stopped, and the EL element 15 is extinguished if it has been activated. Thus, in accordance with this aspect of the present invention, electricity consumed when time display by the analog time display 2 is unnecessary is eliminated, and an energy saving alarm clock is provided.

The operations of the embodiment shown in FIGS. 5, 6 and 7 will be described in more detail with reference to the flow chart shown in FIG. 8. In the energy saving operation mode, the time counting means 1 counts the current time. The digital time display 7 displays the current time. The hour and minute indicator hands are stopped at a predetermined stop position, for example, with each hand pointing to the numeral 6 shown in FIG. 7. In this state, time display by the analog time display is not performed. The current time display flag is in the OFF state. At this time, the control circuit 12 determines whether the current time display flag is in the ON state (step a2) and determines whether the current time display switch 17, which is the switch for instruction of the time display operation by the analog time display 2, is in the ON state (step b2). If the user switches on the current time display switch 17 at this time, the light intensity of the room in which the clock is situated is sensed by the CdS sensor 14 (step c2).

If the room is dark, the control circuit 12 controls the light-up drive circuit 11 and the dial light-up means 8, and flashes the EL element 15 (step d2). By this operation, the user is notified that the adjustment operation has been initiated by switching the current time display switch 17 to the ON position. As the EL element 15 flashes, the current time is output from the time counting means 1, and the current stop positions of the hour hand and the minute hand are output from the indicator hand position memory 5. The positions of each hand and the current time are compared (step e2), and the directions requiring the least amount of movement to position the hands to indicate the current time are calculated (step f2). When the directions of the hands are determined, the hour hand operating motor drive circuit 3 and the minute hand operating motor drive circuit 4 are operated. The hands are moved at high speed in their respective predetermined directions, and their positions adjusted to display the current time (step g2). After completion of the time adjustment, the current time display flag is set (step h2).

The ambient light intensity is again determined (step i2), and if it is dark, the EL element 15 is activated (step j2). If it is determined that the ambient light is above a predetermined level, the EL element 15 is extinguished or not activated (step k2). Subsequently, the process returns to step a2. In this case, it is confirmed that the current time display flag is in the ON state. The normal movement of the indicator hands is thus initiated (step 12), and the time display by the analog time display 2 begins.

When time display is started by the analog time display 2, the control circuit 12 determines whether the current time display switch 17 is on or off (step m2). If the current time display switch 17 is on, then the EL element 15 is controlled dependent on the ambient light intensity (steps i2, j2 and k2). The control circuit 12 verifies the ON state of the current time display flag (step a2), and continues the normal timekeeping movement of the indicator hands.

If the user subsequently turns off the current time display switch 17, the control circuit 12 determines that the current time display switch is off (step m2), and outputs the current time from the time counting means 1, outputs the intended stop positions from the hour hand and minute hand from the indicator hand position memory 5, and compares the intended stop position for each of the hands to the current time (step n2). The control circuit 12 calculates the movement direction of each hand (step o2), and each hand is moved at high speed to its predetermined stop position as shown in FIG. 7 (step p2). When movement of the hands to the stop positions is complete, the control circuit 12 resets the current time display flag (step q2) and stops time display by the analog time display 2. At the same time, the time display by the analog time display is suspended and the EL element 15 is extinguished (step k2). When the analog time display 2 is in the stop state, the time counting means 1 counts the current time count, the digital time display 7 displays the current time, and the control circuit 12 resets the current time display flag and determines the output from the switch means 10 (step b2). If the current time display switch 17 has been turned on, the operations following step c2 are reexecuted, and the current time display is restarted by the analog time display 2. At times when the user is asleep, or away from the alarm clock, the display of the current time by the analog time display 2 is unnecessary. During these times, the current time display switch 17 is turned off, the display operation of the analog time display 2 is stopped, and electrical consumption required to move the time indicator hands is eliminated. Further, the noise accompanying the movement of the indicator hands is eliminated so as not to disturb the user's sleep.

The sound emission block 16 is controlled independently of the display operation of the analog time display. Therefore, even if the display operation of the analog time display 2 is stopped, the sound emission block 16 will emit an alarm tone at an alarm set time stored in the alarm time memory circuit 18.

Furthermore, in accordance with the present invention, the on and off display operations of the analog time display 2 may also be controlled by means of a switch which controls the alarm functions provided in the input means 9. For example, it is possible to stop the display operation of the analog time display 2 by means of the alarm setting so that when the alarm time is reached (during or after the alarm tone generation), time adjustment is performed, and display of the current time is restarted by the analog time display 2. Furthermore, the CdS sensor 14 can be used to stop the analog time display when the room is dark.

The current time display switch 17 can be provided on the bottom surface of the alarm clock. In that case, the switch 17 would be in the OFF state whenever the alarm clock were resting on a surface so that the current time would not normally be displayed by the analog time display 2. However, when the alarm clock is lifted from the surface, the current time display switch 17 switches to the ON state and time adjustment is performed and display of the current time by the analog time display 2 is started. The display of the current time by the analog time display 2 is stopped by putting the alarm clock back down on the surface. In addition, a remote control can be provided for remote control operation to initiate current time display by the analog time display 2, or to announce the current time by sound (such as spoken words) emitted by a speaker.

Thus, in accordance with the present invention, when time display is not necessary, movement of the indicator hands of an analog time display section 2 is stopped, thus conserving energy and reducing noise.

We claim:

1. A timepiece having indicator hands for displaying time, comprising: means for counting time; displaying means including at least movable hour and minute indicator hands for displaying time; controllable adjusting means for adjusting the position of the indicator hands; sensing means for sensing an ambient state in the vicinity of the timepiece and for outputting a state signal dependent thereon; and controlling means for determining if time indication is necessary, for controlling the adjusting means to adjust the position of the indicator hands depending on the state signal such that each of the indicator hands is moved to a respective predetermined stop position when time indication is not necessary, and for controlling the adjusting means to adjust the position of all of the indicator hands to indicate current time when time indication is necessary.

2. A timepiece according to claim 1; wherein the sensing means includes means for sensing ambient light and generating the state signal dependent thereon; and the controlling means includes means for determining that time indication is not necessary when the ambient light is below a predetermined level and for determining that time indication is necessary when the ambient light is above the predetermined level depending on the state signal, for controlling the adjusting means to adjust the position of the indicator hands so that each of the indicator hands is moved to a corresponding predetermined stop position when the ambient light is below the predetermined level, and for controlling the adjusting means to adjust the position of the indicator hands to indicate current time when the ambient light is above the predetermined level.

3. A timepiece according to claim 2; further comprising controllable illuminating means for illuminating the displaying means; and wherein the sensing means includes means for sensing the presence of a person and generating the state signal dependent thereon; and the controlling means includes means for controlling the illuminating means depending on the state signal so that the displaying means is illuminated only when the ambient light is below the predetermined level and the presence of a person is detected.

4. A timepiece according to claim 1; wherein the sensing means includes means for sensing the presence of a person and generating the state signal dependent thereon; and the controlling means includes means for determining that time indication is not necessary when the presence of a person is not sensed and for determining that time indication is necessary when the presence of a person is sensed depending on the state signal, for controlling the adjusting means to adjust the position of the indicator hands so that each of the indicator hands is moved to a corresponding predetermined stop position when the presence of a person is not sensed, and for controlling the adjusting means to adjust the position of the indicator hands to indicate current time when the presence of a person is sensed.

5. A timepiece according to claim 4; further comprising controllable illuminating means for illuminating the displaying means; and wherein the controlling means includes means for controlling the illuminating means depending on the state signal so that the displaying means is not illuminated when the presence of a person is not sensed and the displaying means is illuminated when the presence of a person is sensed.

6. A timepiece according to claim 1; wherein the sensing means includes means for sensing infrared radiation to sense the presence of a person and generating the state signal thereon; and the controlling means includes means for determining that time indication is not necessary when the infrared radiation is below a predetermined level and for determining that time indication is necessary when the infrared radiation is above the predetermined level depending on the state signal, for controlling the adjusting means to adjust the position of the indicator hands so that each of the indicator hands is moved to a corresponding predetermined stop position when the infrared radiation is below the predetermined level, and for controlling the adjusting means to adjust the position of the indicator hands to indicate current time when the infrared radiation is above the predetermined level.

7. A timepiece according to claim 6; further comprising controllable illuminating means for illuminating the displaying means; and wherein the controlling means includes means for controlling the illuminating means depending on the state signal so that the displaying means is not illuminated when the infrared radiation is below a predetermined level and the displaying means is illuminated when the infrared radiation is above the predetermined level.

8. A timepiece according to claim 1; wherein movement of the indicator hands is stopped at a position unusable for time display when time indication is not necessary so as to prevent the misreading of time.

9. A timepiece according to claim 1; wherein the controlling means includes means for calculating the least amount of movement required to displace each of the hour indicator hand and the minute indicator hand, respectively, from a position indicating current time to a corresponding predetermined stop position, and for controlling the adjusting means to move each of the hour indicator hand and the minute indicator hand for the calculated amount of movement to the corresponding predetermined stop position.

10. A timepiece according to claim 1; wherein the controlling means includes means for calculating the least amount of movement required to displace each of the hour indicator hand and the minute indicator hand, respectively, from a corresponding predetermined stop position to a position indicating the current time, and for controlling the adjusting means to move each of the hour indicator hand and the minute indicator hand for the calculated amount of movement from the corresponding predetermined stop position to the position indicating the current time.

11. A timepiece according to claim 1; further comprising digital time displaying means for continually digitally displaying the current time; illuminating means for illuminating the digital time displaying means; and wherein the controlling means includes means for controlling the illuminating means to flash when the position of the indicator hands is being adjusted to indicate current time.

12. A timepiece according to claim 1; further comprising alarm setting means for setting an alarm time; and wherein the controlling means includes means for controlling the adjusting means to adjust the position of the indicator hands to indicate current time after setting of the alarm time.

13. A timepiece according to claim 1; further comprising controllable illuminating means for illuminating the displaying means; and wherein the controlling means includes means for controlling the illuminating means depending on the state signal so that the displaying means is not illuminated when time indication is not necessary and the displaying means is illuminated when time indication is necessary.

14. A timepiece according to claim 1; wherein the respective predetermined stop positions are the same for each indicator hand such that movement of the respective indicator hands is stopped at the same position and the indicator hands each display the same value when time indication is not necessary in order to prevent the misreading of time.

15. A timepiece according to claim 1; wherein the adjusting means adjusts the position of each of the indicator hands from a position indicating current time to a corresponding predetermined stop position at a rate faster than that of the normal display of time.

16. A timepiece according to claim 1; wherein the adjusting means adjusts the position of each of the indicator hands from corresponding predetermined stop position to a position indicating current time at a rate faster than that of normal display of time.

17. A timepiece according to claim 9; wherein the sensing means includes means for sensing the presence of a person and for generating the state signal dependent thereon; and the controlling means includes means for determining that time indication is not necessary when the presence of a person is not sensed, for determining that time indication is necessary when the presence of a person is sensed, depending on the state signal, for controlling the adjusting means to adjust the position of the indicator hands such that each of the indicator hands is is moved to a corresponding predetermined stop position when the presence of a person is not sensed, and for controlling the adjusting means to adjust the position of the indicator hands to indicate current time when the presence of a person is sensed.

18. A timepiece according to claim 11; wherein the sensing means includes means for sensing the presence of a person and for generating the state signal dependent thereon; and the controlling means includes means for determining that time indication by the indicator hands is not necessary when the presence of a person is not sensed, for determining that time indication is necessary when the presence of a person is sensed, depending on the state signal, for controlling the adjusting means to adjust the position of the indicator hands such that each of the indicator hands is moved to a corresponding predetermined stop position when the presence of a person is not sensed, and for controlling the adjusting means to adjust the position of the indicator hands to indicate current time when the presence of a person is sensed.

19. A timepiece operable in plural modes and having indicator hands for displaying time, comprising: time counting means for counting time; displaying means including movable indicator hands for displaying time; adjusting means for adjusting the position of the indicator hands; sensing means for sensing an ambient state and outputting a state signal dependent thereon; switching means for switching an operation mode of the timepiece and outputting a mode signal dependent thereon; and controlling means for controlling movement of the indicator hands depending on the state signal and the mode signal; wherein the switching means includes means for manually switching the operation mode between a constant time display mode and an interrupted time display mode; and the controlling means has means operative when the timepiece is in the constant time display mode for controlling the adjusting means to continually adjust the position of the indicator hands to indicate the current time, and operative when the timepiece is in the interrupted time display mode for determining when time indication is necessary dependent on the state signal, for controlling the adjusting means to adjust the position of the indicator hands so that each of the indicator hands is moved to a respective predetermined stop position when time indication is not necessary and for controlling the adjusting means to adjust the position of the indicator hands to indicate current time when time indication is necessary.

20. A timepiece according to claim 19; wherein the sensing means includes means for sensing ambient light and generating the state signal dependent thereon; and wherein the controlling means has means operative when the timepiece is in the interrupted time display mode for determining that time indication is not necessary when the ambient light is below a predetermined level and for determining that time indication is necessary when the ambient light is above the predetermined level depending on the state signal, for controlling the adjusting means to adjust the position of the indicator hands so that each of the indicator hands is moved to a corresponding predetermined stop position when the ambient light is below the predetermined level, and for controlling the adjusting means to adjust the position of the indicator hands to indicate current time when the ambient light is above the predetermined level.

21. A timepiece according to claim 19; further comprising controllable illuminating means for illuminating the displaying means; and wherein the sensing means includes means for sensing ambient light and generating the state signal dependent thereon; and the controlling means includes means operative when the timepiece is in the constant time display mode for controlling the illuminating means to illuminate the displaying means when the ambient light is below a predetermined level, and means operative when the timepiece is in the interrupted time display mode for determining that time indication is not necessary when the ambient light is below a predetermined level and for determining that time indication is necessary when the ambient light is above the predetermined level depending on the state signal, for controlling the adjusting means to adjust the position of the indicator hands so that each of the indicator hands is moved to a corresponding predetermined stop position when the ambient light is below the predetermined level, and for controlling the adjusting means to adjust the position of the indicator hands to indicate current time when the ambient light is above the predetermined level.

22. A timepiece according to claim 19; wherein the sensing means includes means for sensing the presence of a person and generating the state signal dependent thereon; and the controlling means includes means operative when the timepiece is in the interrupted time display mode for determining that time indication is not necessary when the presence of a person is not sensed and for determining that time indication is necessary when the presence of a person is sensed depending on the state signal, for controlling the adjusting means to adjust the position of the indicator hands so that each of the indicator hands is moved to a corresponding predetermined stop position when the presence of a person is sensed, and for controlling the adjusting means to adjust the position of the indicator hands to indicate current time when the presence of a person is sensed.

23. A timepiece according to claim 19; further comprising controllable illuminating means for illuminating the displaying means; and wherein the sensing means includes means for sensing the presence of a person and for sensing ambient light and generating the state signal dependent thereon; and the controlling means includes means operative when the timepiece is in the constant time display mode for controlling the illuminating means to illuminate the displaying means when the presence of a person is sensed and the ambient light is below a predetermined level, and means operative when the timepiece is in the interrupted time display mode for determining that time indication is not necessary when the presence of a person is not sensed and for determining that time indication is necessary when the presence of a person is sensed depending on the state signal, for controlling the adjusting means to adjust the position of the indicator hands so that each of the indicator hands is moved to a corresponding predetermined stop position when the presence of a person is not sensed, for controlling the adjusting means to adjust the position of the indicator hands to indicate current time when the presence of a person is sensed, and for controlling the illuminating means to illuminate the displaying means when the presence of a person is sensed.

24. A timepiece according to claim 19; further comprising digital time displaying means for continually digitally displaying the current time; illuminating means for illuminating the digital time displaying means; and wherein the controlling means includes means for controlling the illuminating means to flash when the position of the indicator hands is being adjusted to indicate current time.

25. A timepiece having indicator hands for displaying time, comprising: time counting means for counting time; displaying means including at least movable hour and minute indicator hands for displaying time; controllable adjusting means for adjusting the position of the indicator hands; detecting means for detecting whether or not time indication is necessary; and controlling means for controlling the adjusting means to adjust the position of the indicator hands so that each of the indicator hands is moved to a respective predetermined stop position when the detecting means detects that time indication is not necessary, and for controlling the adjusting means to adjust the position of each of the indicator hands to indicate current time when the detecting means detects that time indication is necessary.

26. A timepiece according to claim 25; further comprising alarm setting means for setting an alarm time; and wherein the detecting means includes means for detecting that time indication is not necessary when an alarm is set.

27. A timepiece having indicator hands for displaying time, comprising: time counting means for counting time; displaying means including at least movable hour and minute indicator hands for displaying time; controllable adjusting means for adjusting the position of the indicator hands; detecting means for detecting whether or not time indication is necessary; controlling means for controlling the adjusting means to adjust the position of the indicator hands so that each of the indicator hands is moved to a respective predetermined stop position when the detecting means detects that time indication is not necessary, and for controlling the adjusting means to adjust the position of each of the indicator hands to indicate current time when the detecting means detects that time indication is necessary; alarm setting means for setting an alarm time; and wherein the detecting means includes means for detecting that time indication is not necessary when an alarm is set and for detecting that time indication is necessary when the set alarm time is reached.

28. A timepiece according to claim 25; wherein the detecting means includes means for detecting whether or not time indication is necessary based on the level of ambient light.

29. A timepiece according to claim 25; wherein the detecting means includes means for detecting whether or not time indication is necessary based on the proximity of a person to the timepiece.

30. A timepiece having indicator hands for displaying time, comprising: time counting means for counting time; displaying means including indicator hands for displaying time; controllable adjusting means for adjusting the position of the indicator hands; sensing means for sensing an ambient state in the vicinity of the timepiece, the sensing means including means for sensing the presence of a person in the vicinity of the timepiece and for outputting a first state signal dependent thereon, and means for sensing ambient light in the vicinity of the timepiece and for outputting a second state signal dependent thereon; controllable illuminating means for illuminating the displaying means; and controlling means for determining if time indication is necessary, for controlling the adjusting means to adjust the position of the indicator hands depending on the first and second state signals such that each of the indicator hands is moved to a respective predetermined stop position when the ambient light is below a predetermined level, for controlling the adjusting means to adjust the position of the indicator hands to indicate current time when the ambient light is above the predetermined level, and for controlling the illuminating means depending on the first and second state signals such that the display means is illuminated only when the ambient light is below a predetermined level and the presence of a person is sensed.

31. A timepiece having indicator hands for displaying time, comprising: time counting means for counting time; displaying means including indicator hands for displaying time; controllable adjusting means for adjusting the position of the indicator hands; sensing means for sensing an ambient state in the vicinity of the timepiece, the sensing means including means for sensing the presence of a person in the vicinity of the timepiece and for outputting a first state signal dependent thereon, and means for sensing ambient light in the vicinity of the timepiece and for outputting a second state signal dependent thereon; controllable illuminating means for illuminating the displaying means; and controlling means for determining if time indication is necessary, for controlling the adjusting means to adjust the position of the indicator hands depending on the first and second state signals such that each of the indicator hands is moved to a respective predetermined stop position when the presence of a person is not sensed, for controlling the adjusting means to adjust the position of the indicator hands to indicate current time when the presence of a person is sensed, and for controlling the illuminating means depending on the first and second state signals such that the display means is illuminated only when the ambient light is below a predetermined level and the presence of a person is sensed.

32. A timepiece having indicator hands for displaying time, comprising: time counting means for counting time; displaying means including movable indicator hands for displaying time; controllable adjusting means for adjusting the position of the indicator hands; sensing means for sensing an ambient state in the vicinity of the timepiece, including means for sensing the presence of a person in the vicinity of the timepiece and for outputting a state signal dependent thereon; and controlling means for determining if time indication is necessary, for controlling the adjusting means to adjust the position of the indicator hands depending on the state signal such that each of the indicator hands is moved to a respective predetermined stop position when the presence of a person is not sensed, and for controlling the adjusting means to adjust the position of the indicator hands to indicate current time when the presence of a person is sensed.

33. A timepiece having indicator hands for displaying time, comprising: time counting means for counting time; displaying means including movable indicator hands for displaying time; controllable adjusting means for adjusting the position of the indicator hands; alarm setting means for setting an alarm time and generating a state signal dependent thereon; alarm generating means for generating an alarm at the alarm time; alarm stopping means for stopping the generation of the alarm; and controlling means for controlling the adjusting means to adjust the position of the indicator hands depending on the state signal from the alarm setting means such that each of the indicator hands moved to a respective predetermined stop position after setting of the alarm, and for controlling the adjusting means to adjust the position of the indicator hands to indicate current time in response to the generation of the alarm.

34. A timepiece having indicator hands for displaying time, comprising: time counting means for counting time; displaying means including at least movable hour and minute indicator hands for displaying time; controllable adjusting means for adjusting the position of the indicator hands; sensing means for sensing an ambient state in the vicinity of the timepiece and for outputting a state signal dependent thereon; and controlling means for determining if time indication is necessary, for controlling the adjusting means to adjust the position of each of the indicator hands depending on the state signal so that each of the indicator hands is moved to a predetermined position unusable for time indication when time indication is not necessary, and for controlling the adjusting means to adjust the position of the indicator hands to indicate current time when time indication is necessary.

35. A timepiece having indicator hands for displaying time, comprising: time counting means for counting time; displaying means including movable indicator hands for displaying time; controllable adjusting means for adjusting the position of the indicator hands; switching means for selecting a continuous current time display mode or an energy saving display mode and for outputting a state signal dependent thereon; and controlling means for determining if time indication is necessary, for controlling the adjusting means to adjust the position of the indicator hands depending on the state signal such that the indicator hands are moved to a predetermined position unusable for time indication when time indication is not necessary, and for controlling the adjusting means to adjust the position of the indicator hands to indicate current time when time indication is necessary.

* * * * *